US010349749B2

(12) United States Patent
Su

(10) Patent No.: US 10,349,749 B2
(45) Date of Patent: Jul. 16, 2019

(54) MOVABLE TABLET FOR CONNECTING A CHAIR

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 0 days.

(21) Appl. No.: 15/821,779

(22) Filed: Nov. 23, 2017

(65) Prior Publication Data

US 2019/0090648 A1 Mar. 28, 2019

(30) Foreign Application Priority Data

Sep. 22, 2017 (CN) ..... 2017 1 0863197

(51) Int. Cl.
*A47C 7/70* (2006.01)
*A47C 7/68* (2006.01)

(52) U.S. Cl.
CPC . *A47C 7/70* (2013.01); *A47C 7/68* (2013.01)

(58) Field of Classification Search
CPC ..... A47C 7/68; A47C 7/70
USPC ..... 297/160–162, 173
See application file for complete search history.

(56) References Cited

U.S. PATENT DOCUMENTS 5,087,096 A * 2/1992 Yamazaki ..... A47C 7/70 297/145
5,845,964 A * 12/1998 Phoon ..... A47C 7/70 297/162
6,073,997 A * 6/2000 Koh ..... A47C 7/70 297/162
6,669,282 B2 * 12/2003 Piretti ..... A47C 3/04 297/162
7,370,910 B2 * 5/2008 Piretti ..... A47C 7/70 297/162
7,695,061 B2 * 4/2010 Olarte ..... A47C 7/70 297/162
8,668,257 B2 * 3/2014 Wu ..... A47C 7/70 248/446
8,746,788 B2 * 6/2014 Su ..... A47C 7/70 297/162

* cited by examiner

*Primary Examiner* — Syed A Islam

(57) ABSTRACT

The movable tablet includes a shaft fixed to an armrest and having a radial pin hole. A connecting seat has a first connecting portion toward the shaft and a second connecting portion. The first connecting portion is axially rotatably connected to the shaft. The second connecting portion has a through hole axially corresponding to the pin hole. A pin passes through the through hole and the pin hole to prevent the first connecting portion from rotating relative to the shaft. A tablet is rotatably connected to the second connecting portion. A releaser is disposed on the tablet to make the pin escape from the pin hole when the tablet is horizontally rotating so that the tablet can be turned vertically.

9 Claims, 9 Drawing Sheets

MOVABLE TABLET FOR CONNECTING A CHAIR

BACKGROUND OF THE INVENTION

1. Technical Field

The invention relates to chairs with a tablet, particularly to a movable tablet arm which is fold-down and flip-up.

2. Related Art

A chair with a tablet is very useful and always used in a classroom or meeting room. Such chairs can be divided into two types, the one is of a fixed tablet, and the other one is of a fold-down tablet. The fold-down tablet can be folded aside when not in use so that it is convenient to pass in and out for users.

A conventional fold-down tablet is provided with a rotation mechanism for rotating the tablet horizontally and vertically. However, such a conventional tablet does not provide a locking mechanism to prevent the tablet from unexpectedly raising which may cause dropping of everything on the tablet. This is a problem to be solved.

SUMMARY OF THE INVENTION

An object of the invention is to provide a movable tablet for a chair, which can be locked when the tablet is set to a horizontal position to prevent unexpectedly raising.

To accomplish the above object, the movable tablet of the invention includes: a shaft, fixed to the arm, and having a radial pin hole; a connecting seat, having a first connecting portion toward the shaft and a second connecting portion, wherein the first connecting portion is axially rotatably connected to the shaft, the second connecting portion has a through hole axially corresponding to the pin hole, a pin passes through the through hole and the pin hole to prevent the first connecting portion from rotating relative to the shaft; a tablet; and a support base, connected to a bottom of the tablet, having a passing hole being passed by the second connecting portion for being rotatable about the second connecting portion, wherein a releaser is disposed on the support base, the releaser has a rising slope corresponding to the pin, and the pin is formed with a head which is capable of climbing the rising slope.

DETAILED DESCRIPTION OF THE INVENTION

Figure 1:
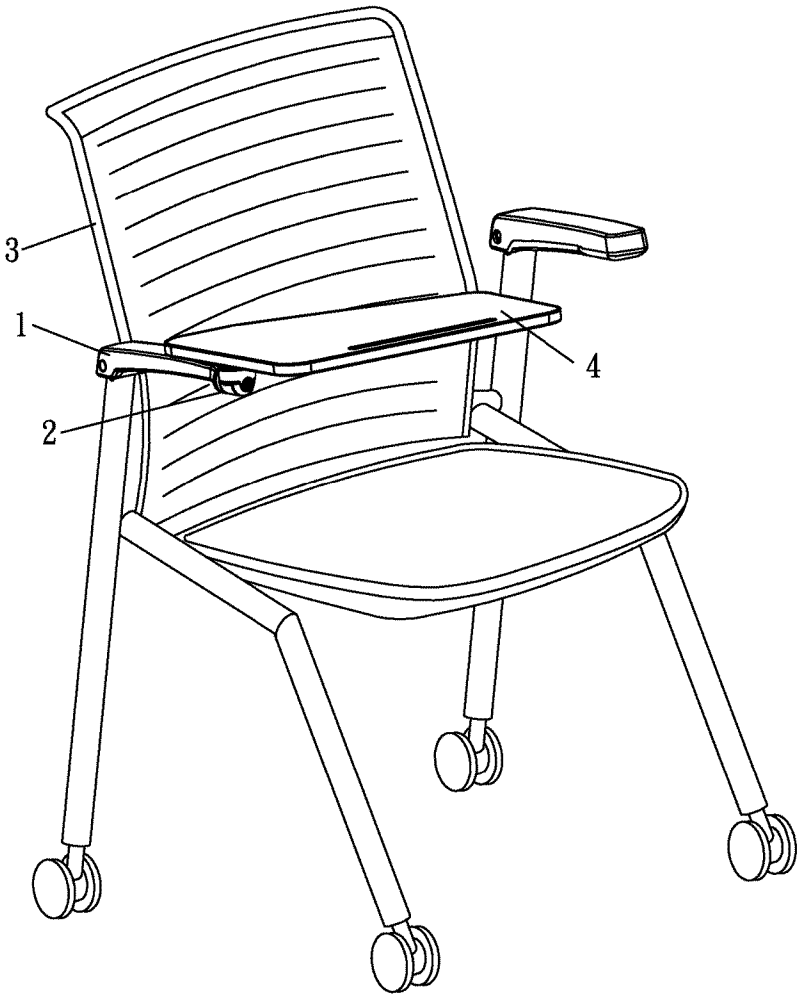
FIG. 1 is a schematic view of the invention installed to a chair.

Please refer to FIGS. 1-6. The tablet 4 of the invention is connected to an arm 1, such as an armrest, at a side of a chair 3 through a connecting seat 2. An end of the arm 1 is provided with a shaft 11 with a radial pin hole 112. The shaft 11 has a connecting end 111, such as a shaft hole shown in FIG. 3, for connecting with the connecting seat 2 so that the connecting seat 2 can rotate relative to the shaft 11. Preferably, the shaft 11 is formed with a limiting recess 113 for matching with the connecting seat 2 to limit a rotating angle of the connecting seat 2, whose details will be described behind.

The connecting seat 2 has a first connecting portion 21 corresponding to the shaft 11 and a second connecting portion 22 corresponding to the tablet 4.

The first connecting portion 21 has an open chamber 211 which allows the shaft 11 to be inserted into. A bolt 212 is inserted into the chamber 211 to screw with the connecting end 111 for connecting with the shaft 11 so as to make the first connecting portion 21 rotatable relative to the shaft 11. In addition, a protrusion 213 corresponding to the limiting recess 113 is formed in the chamber 211. The protrusion 213 is less than the limiting recess 113 in volume so that the protrusion 213 can be received in the limiting recess 113. In other words, when the first connecting portion 21 rotates relative to the shaft 11, the protrusion 213 is limited in the limiting recess 113 to move so that a rotating angle of the connecting seat 2 on the shaft 11.

An O-ring 114 is put around the shaft 11 and located in the chamber 211 to touch the first connecting portion 21 so that the first connecting portion 21 rotates relative to the shaft 11 with a certain resistance. Preferably, a sleeve 23 is first connected in the chamber 211 to move with the first connecting portion 21. The sleeve 23 encompasses and touches the O-ring 114 to avoid a direct touch between the first connecting portion 21 and the O-ring 114, which will cause rapidly wearing off.

The second connecting portion 22 has a through hole 221 communicating with the chamber 211 and axially corresponding to the pin hole 112 of the shaft 11 in the chamber 211. A pin 24 passes through the through hole 221 and the pin hole 112 to prevent the connecting seat 2 from rotating relative to the shaft 11. In other words, the connecting seat 2 can rotate relative to the shaft 11 only when the pin 24 is removed from the pin hole 112.

Figure 2:
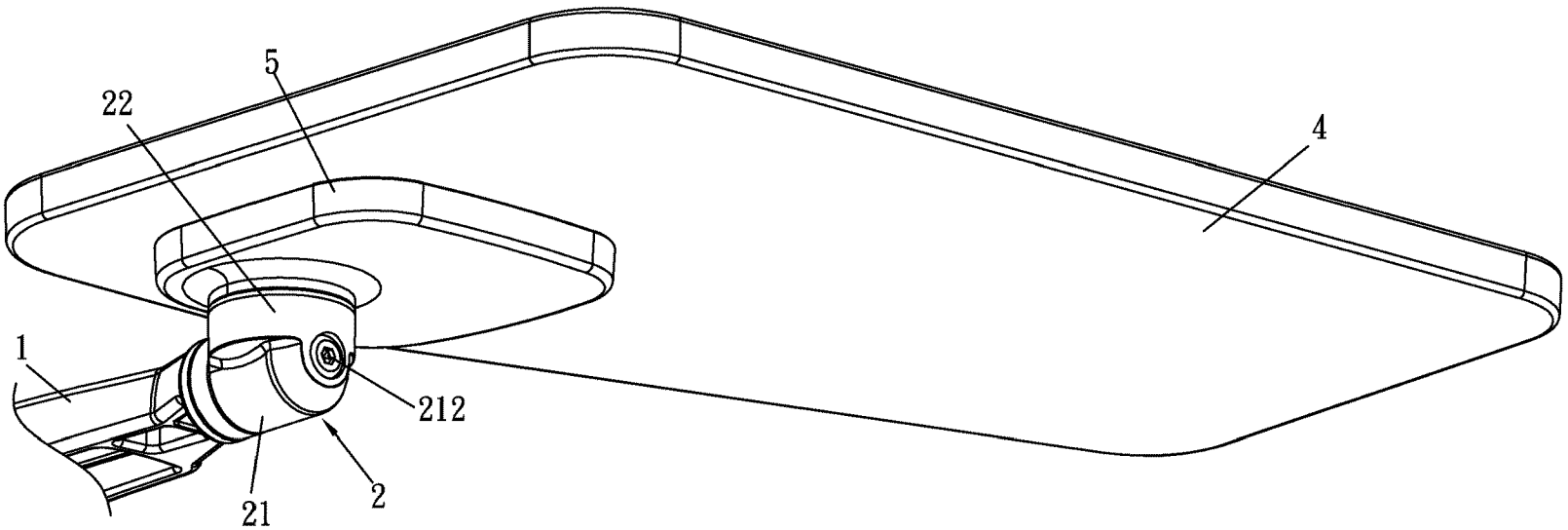
FIG. 2 is a schematic view of the invention.
Figure 3:
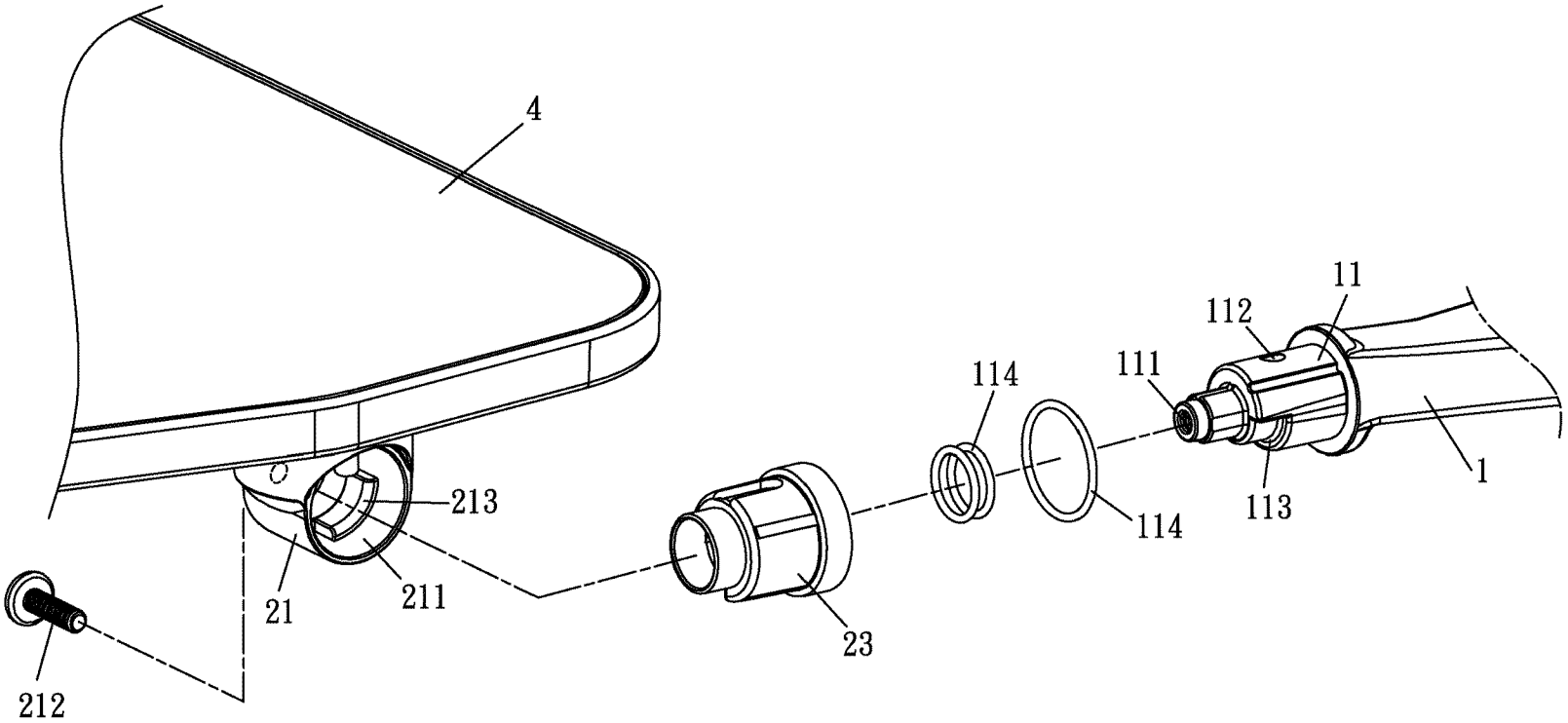
FIG. 3 is an exploded view of the invention.
Figure 4:
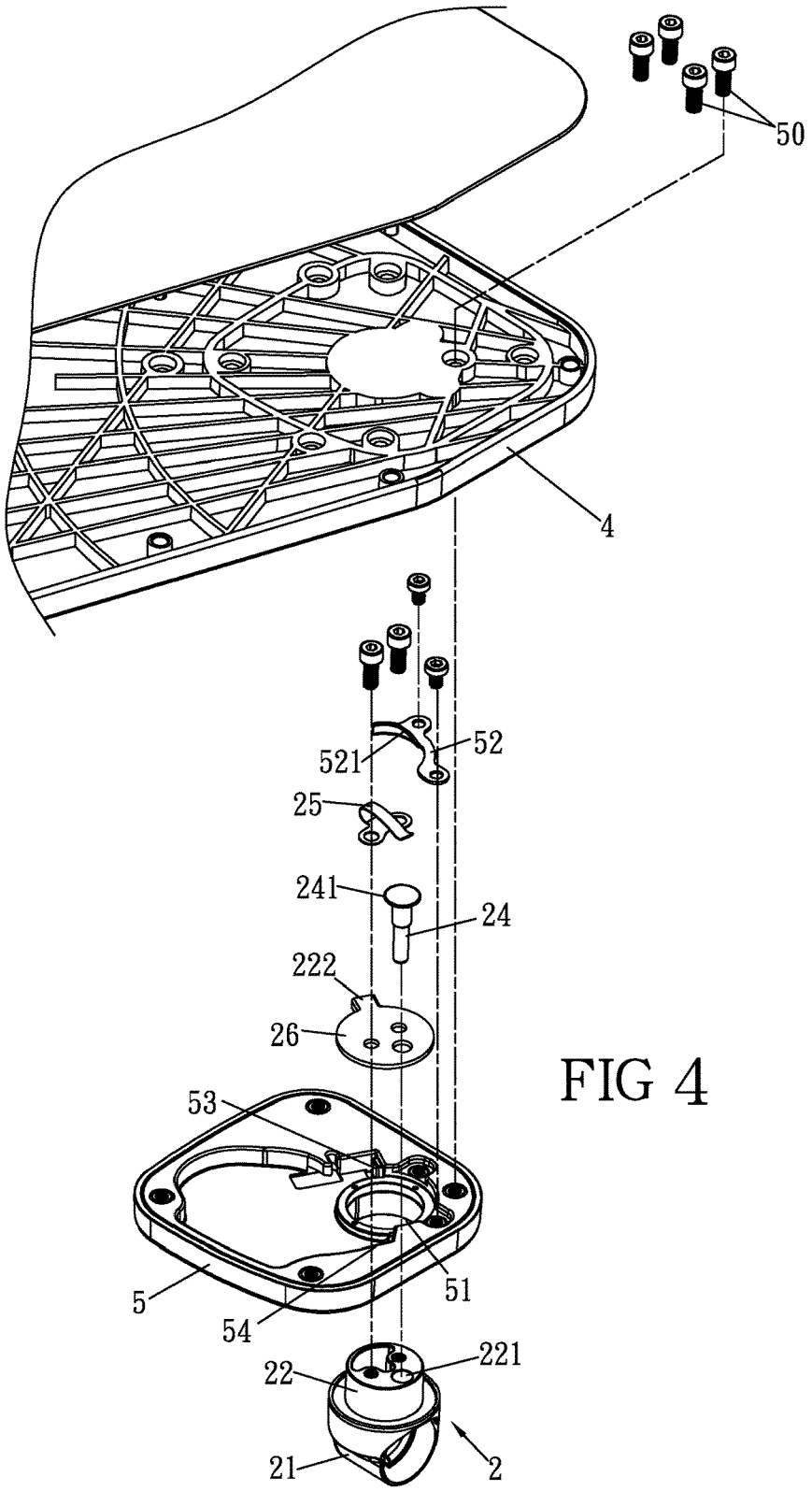
FIG. 4 is another exploded view of the invention.

Please refer to FIGS. 2 and 4. A support base 5 is connected between the tablet 4 and the connecting seat 2. Preferably, the support base 5 is fixed to the bottom of the tablet 4 by screws 6. The support base 5 has a passing hole 51 being passed by the second connecting portion 22 to make the tablet 4 rotatable about the second connecting portion 22. A releaser 52 is disposed on the support base 5 near the passing hole 51. The releaser 52 has an arc-shaped rising slope 521 corresponding to the pin 24 in the second connecting portion 22. The pin 24 is formed with a head 241 which is capable of climbing the rising slope 521. In detail, when the pin 24 is inserted into the through hole 221 and the pin hole 112, a lower end of the rising slope 521 is located between the head 241 and the support base 5. In addition, the second connecting portion 22 is further connected with an elastic member 25 whose one end presses the top of the pin 24 to prevent the pin 24 from escaping from the through hole 221.

To prevent undesired impacts or nipping fingers caused by excessive rotating angle of the tablet 4, two blocking walls 53, 54 are formed around the passing hole 51 on the support base 5 with the same radius. The phase difference between the two blocking walls 53, 54 is set to 150 degrees. A limiting block 222 is extended from the second connecting portion 22 toward a region within the phase difference. In other words, when the tablet 4 is rotated relative to the second connecting portion 22, the tablet 4 will be stopped once either of the blocking walls 53, 54 is touched by the limiting block 222 so that the tablet 4 can be rotated up to 150 degrees. Also, because the limiting block 222 blocks the passing hole 51, the tablet 4 can be prevented from escaping from the second connecting portion 22. Preferably, the limiting block 222 may be formed on a steering plate 26 connected to the second connecting portion 22 as shown in FIG. 4.

Figure 5:
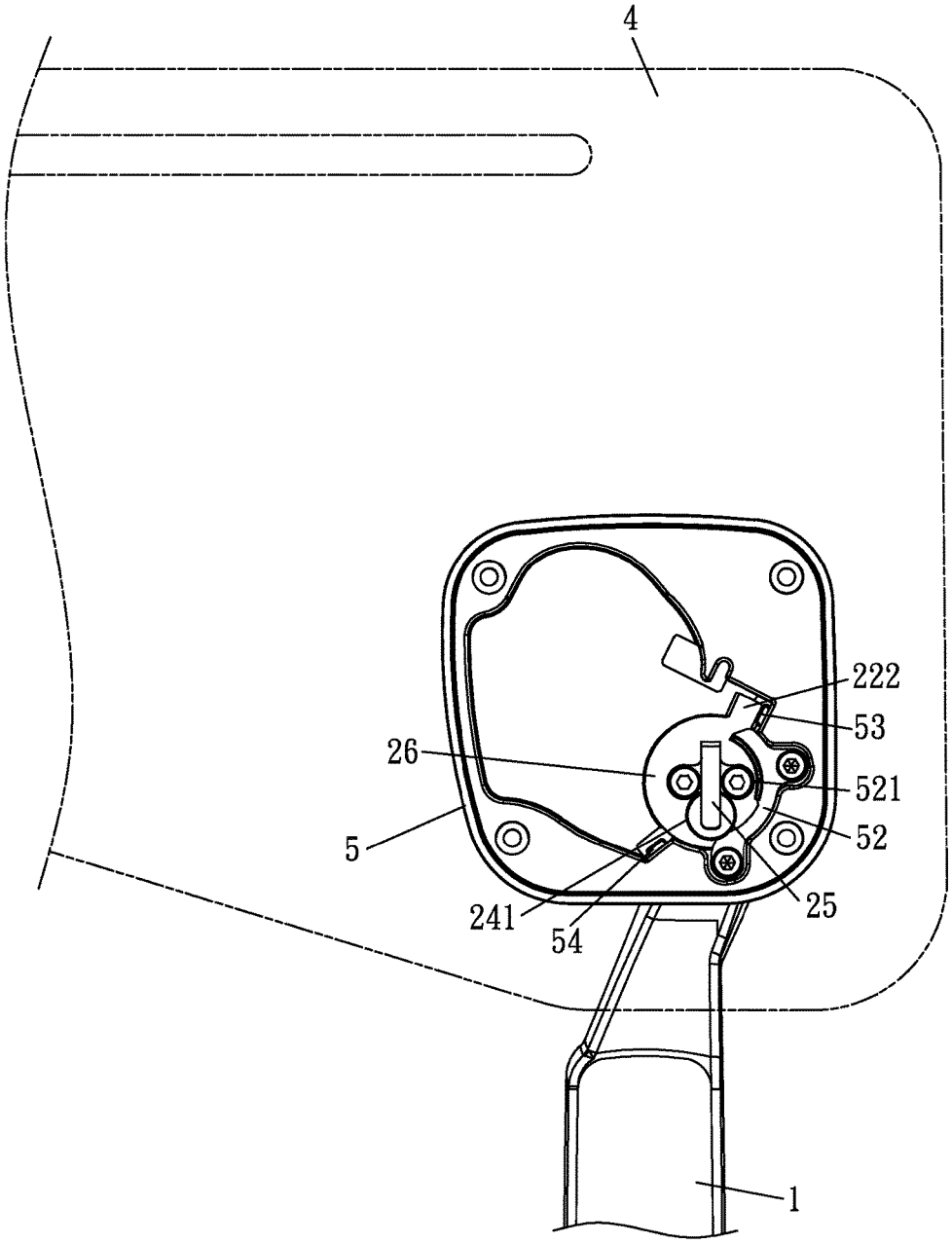
FIG. 5 is a top view of the invention for showing components supporting the tablet.
Figure 6:
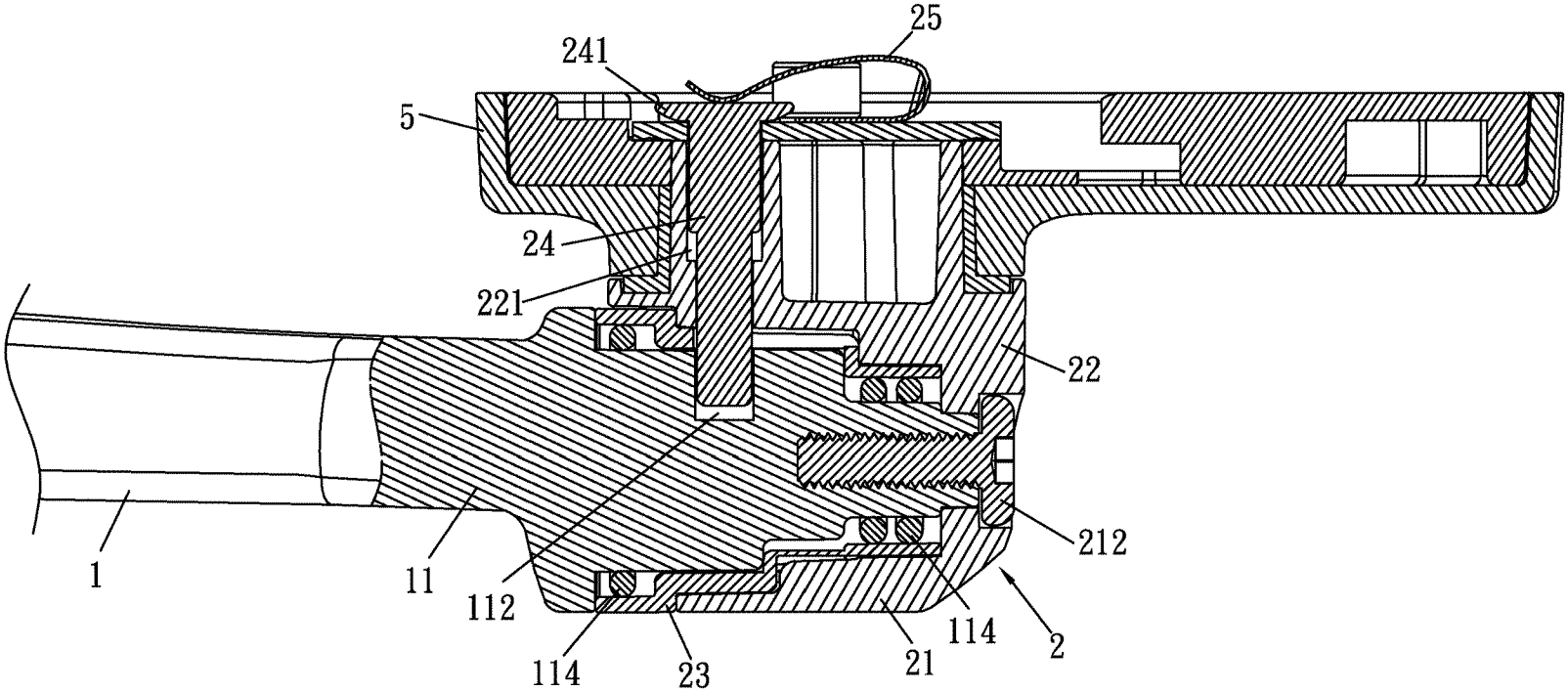
FIG. 6 is a cross-sectional view of the invention in FIG. 5.

As for the operation of the invention, please refer to FIGS. 5-9. As shown in FIGS. 5 and 6, when a user sets the tablet 4 to a horizontal position to use the tablet 4 to put objects or write, the tablet 4 is fixed on the shaft 11 through the connecting seat 2. At this time, the pin 24 is directly inserted into the through hole 221 and the pin hole 112. As above-mentioned, the connecting seat 2 cannot rotate relative to the shaft 11. That is, the tablet 4 cannot be rotated to a vertical position and can only be horizontally rotated about the second connecting portion 22. And its rotating range is 150 degrees defined by the phase difference between the two blocking walls 53, 54.

Figure 7:
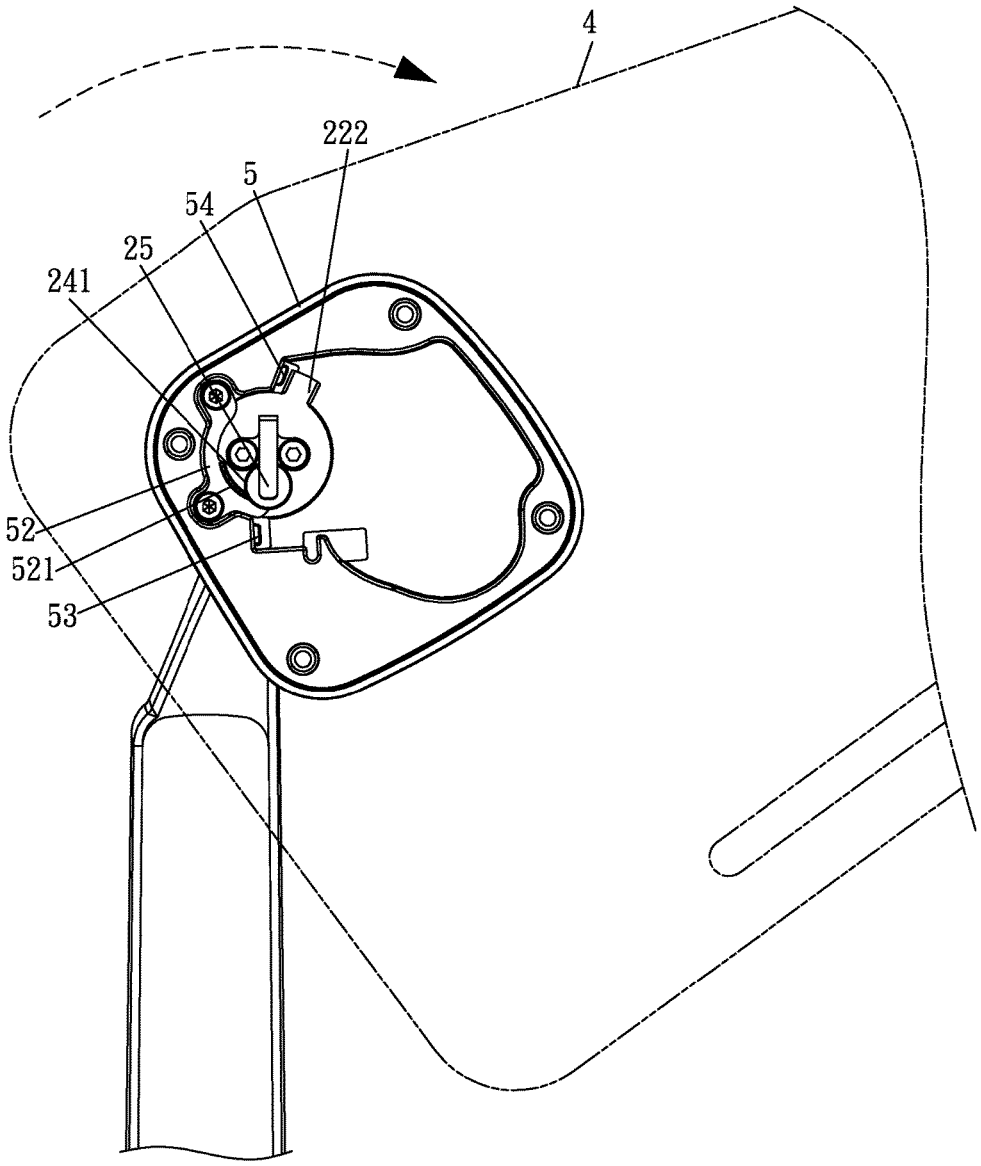
FIG. 7 is a top view of the invention for showing the tablet being rotated.
Figure 8:
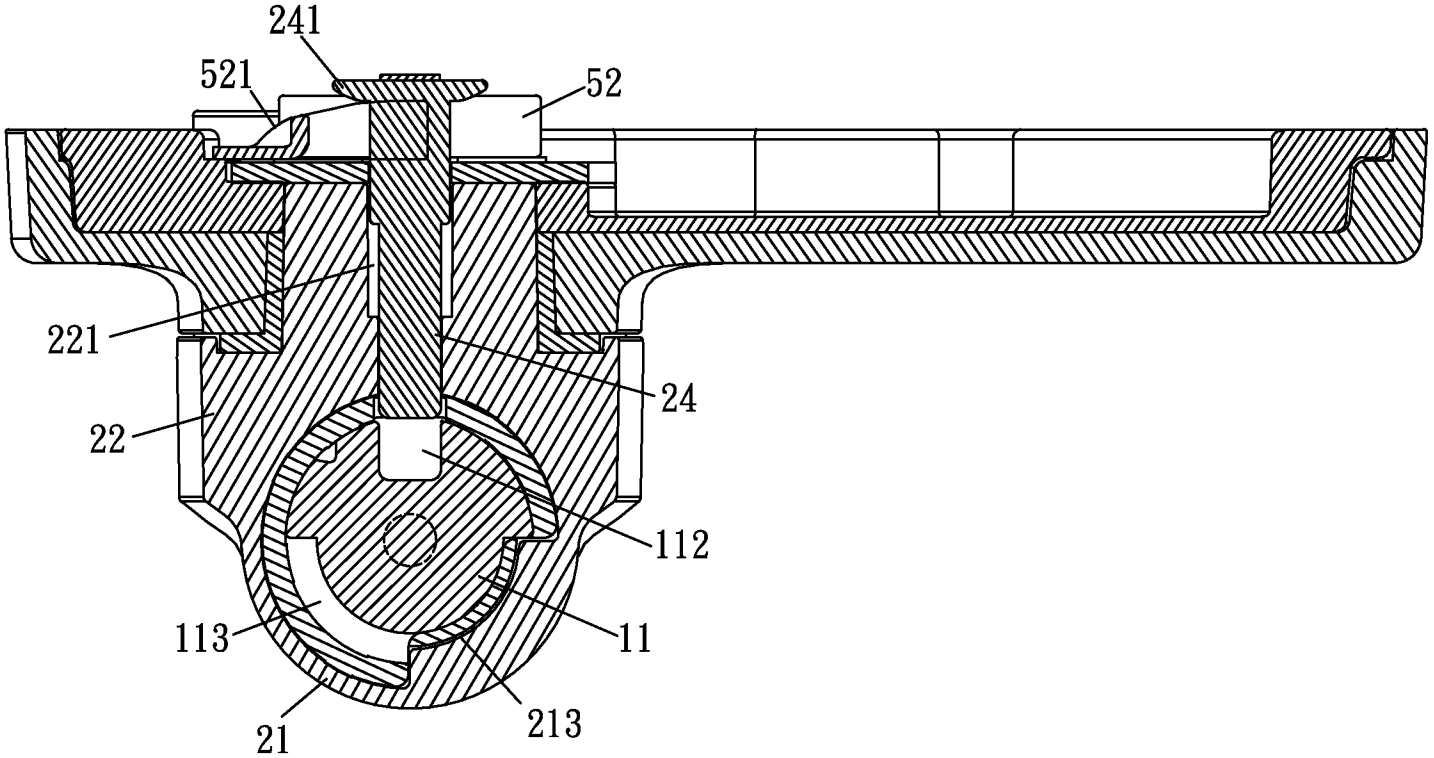
FIG. 8 is a cross-sectional view of the invention in FIG. 7.
Figure 9:
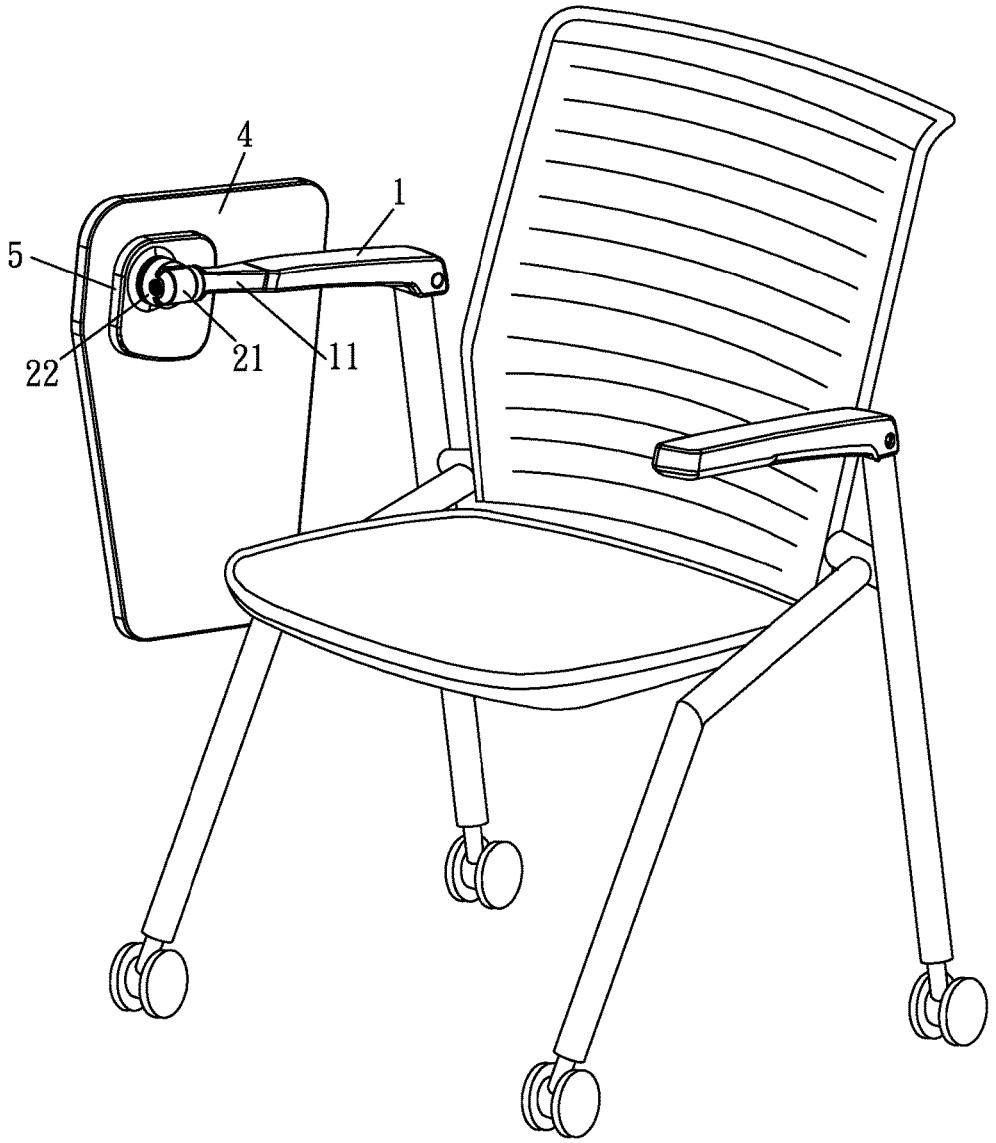
FIG. 9 is a schematic view of the invention with a chair for showing the tablet being folded down to a side of the chair.

When a user wants to fold down the tablet 4, he or she may operate as FIGS. 7 and 8. First, rotate the tablet 4 outward clockwise. At this time, the releaser 52 corresponding to the pin 52 rotates with the support base 5 so that the head 241 of the pin 24 climbs to the higher end along the rising slope 521 to escape from the pin hole 112 and the shaft 11 is not limited by the pin 24 any longer. As a result, the tablet 4 can be rotated to a vertical position as shown in FIG. 9. In this process, the pin 24 is always pressed by the elastic member 25 to prevent from escaping from the through hole 221. The resistance from the O-ring 114 can lower the rotation speed. Also, because the protrusion 213 is limited in the limiting recess 113 when the first connecting portion 21 is rotated relative to the shaft 11, the rotating angle of the connecting seat 2 on the shaft 11 is limited to prevent the rotation of the tablet 4 is excessively fast in speed or excessively large in angle.

What is claimed is:

1. A movable tablet for connecting an arm at a side of a chair, comprising:

a shaft, fixed to the arm, and having a radial pin hole;

a connecting seat, having a first connecting portion toward the shaft and a second connecting portion, wherein the first connecting portion is axially rotatably connected to the shaft, the second connecting portion has a through hole axially corresponding to the radial pin hole, a pin passes through the through hole and the radial pin hole to prevent the first connecting portion from rotating relative to the shaft;

a tablet; and a support base, connected to a bottom of the tablet, having a passing hole being passed by the second connecting portion for being rotatable about the second connecting portion, wherein a releaser is disposed on the support base, the releaser has a rising slope corresponding to the pin, and the pin is formed with a head which is capable of climbing the rising slope.

2. The movable tablet of claim 1, wherein the second connecting portion is further connected with an elastic member whose one end presses a top of the pin.

3. The movable tablet of claim 1, wherein two blocking walls are formed around the passing hole on the support base with an identical radius, a phase difference is formed between the two blocking walls, and a limiting block is extended from the second connecting portion toward a region within the phase difference.

4. The movable tablet of claim 3, wherein the limiting block is formed on a steering plate connected to the second connecting portion.

5. The movable tablet of claim 3, wherein the phase difference between the two blocking walls is about 150 degrees.

6. The movable tablet of claim 1, wherein the first connecting portion has an open chamber which allows the shaft to be inserted into, and an O-ring is put around the shaft and located in the open chamber to touch the first connecting portion.

7. The movable tablet of claim 6, wherein a sleeve is connected in the open chamber, the sleeve encompasses and touches the O-ring.

8. The movable tablet of claim 1, wherein the first connecting portion has an open chamber which allows the shaft to be inserted into, the shaft is formed with a limiting recess, the first connecting portion, a protrusion corresponding to the limiting recess is formed in the open chamber, the protrusion is less than the limiting recess in volume so that the protrusion is received in the limiting recess and a rotating angle of the first connecting portion on the shaft is limited.

9. The movable tablet of claim 1, wherein the first connecting portion has an open chamber which allows the shaft to be inserted into, a bolt is inserted into the open chamber to screw with the connecting end for connecting with the shaft so as to make the first connecting portion rotatable relative to the shaft.

* * * * *